United States Patent [19]

Stupakis

[11] Patent Number: 4,778,216

[45] Date of Patent: Oct. 18, 1988

[54] LIGHTWEIGHT TRANSPORTABLE DENTAL CHAIR

[75] Inventor: John S. Stupakis, Arcadia, Calif.

[73] Assignee: JSS Scientific Corporation, Arcadia, Calif.

[21] Appl. No.: 40,024

[22] Filed: Apr. 20, 1987

[51] Int. Cl.[4] ..... A47C 3/20; A47C 4/52; A47C 4/54

[52] U.S. Cl. ..... 297/17; 248/157; 248/631; 297/345; 297/DIG. 3; 297/DIG. 8

[58] Field of Search ..... 297/17, 345, DIG. 3, 297/DIG. 8; 248/157, 161, 188.6, 188.7, 631

[56] References Cited

U.S. PATENT DOCUMENTS

| | | | |
|---|---|---|---|
| 271,596 | 2/1883 | Browne . | |
| 1,373,079 | 3/1921 | King | 297/345 |
| 2,397,766 | 4/1946 | Tullis | 248/188.6 X |
| 2,731,652 | 1/1956 | Bishop | 297/DIG. 3 |
| 3,112,956 | 12/1963 | Schick et al. | 297/219 |
| 3,179,465 | 4/1985 | Roberts | 297/17 |
| 3,419,309 | 12/1968 | Smith | 297/17 X |
| 3,682,431 | 8/1972 | Vivian | 248/631 |
| 3,909,061 | 9/1975 | Johnson | 297/17 |
| 4,504,989 | 3/1985 | Maltz | 5/455 |
| 4,538,854 | 9/1985 | Wilson | 297/DIG. 8 |

FOREIGN PATENT DOCUMENTS

| | | | |
|---|---|---|---|
| 241818 | 11/1962 | Australia | 248/631 |
| 3119867 | 12/1982 | Fed. Rep. of Germany | 297/DIG. 8 |
| 2333472 | 7/1977 | France | 297/345 |
| 2550070 | 2/1985 | France | 297/17 |
| 178937 | 11/1982 | Japan | 297/DIG. 3 |

*Primary Examiner*—Kenneth J. Dorner
*Assistant Examiner*—Peter Brown
*Attorney, Agent, or Firm*—John G. Mesaros

[57] ABSTRACT

A field portable dental chair, collapsible to suitcase size, with pivotable outriggers for support, the chair including a bellows arrangement with a telescopic internal structure for raising and lowering the seat of the chair. The apparatus is formed, in part, of rigid members and, in part, flexible members contained within the rigid members for portability. Inflatable cushion members are provided for support of the head, back, seat and legs of a patient.

20 Claims, 2 Drawing Sheets

FIG. 1.
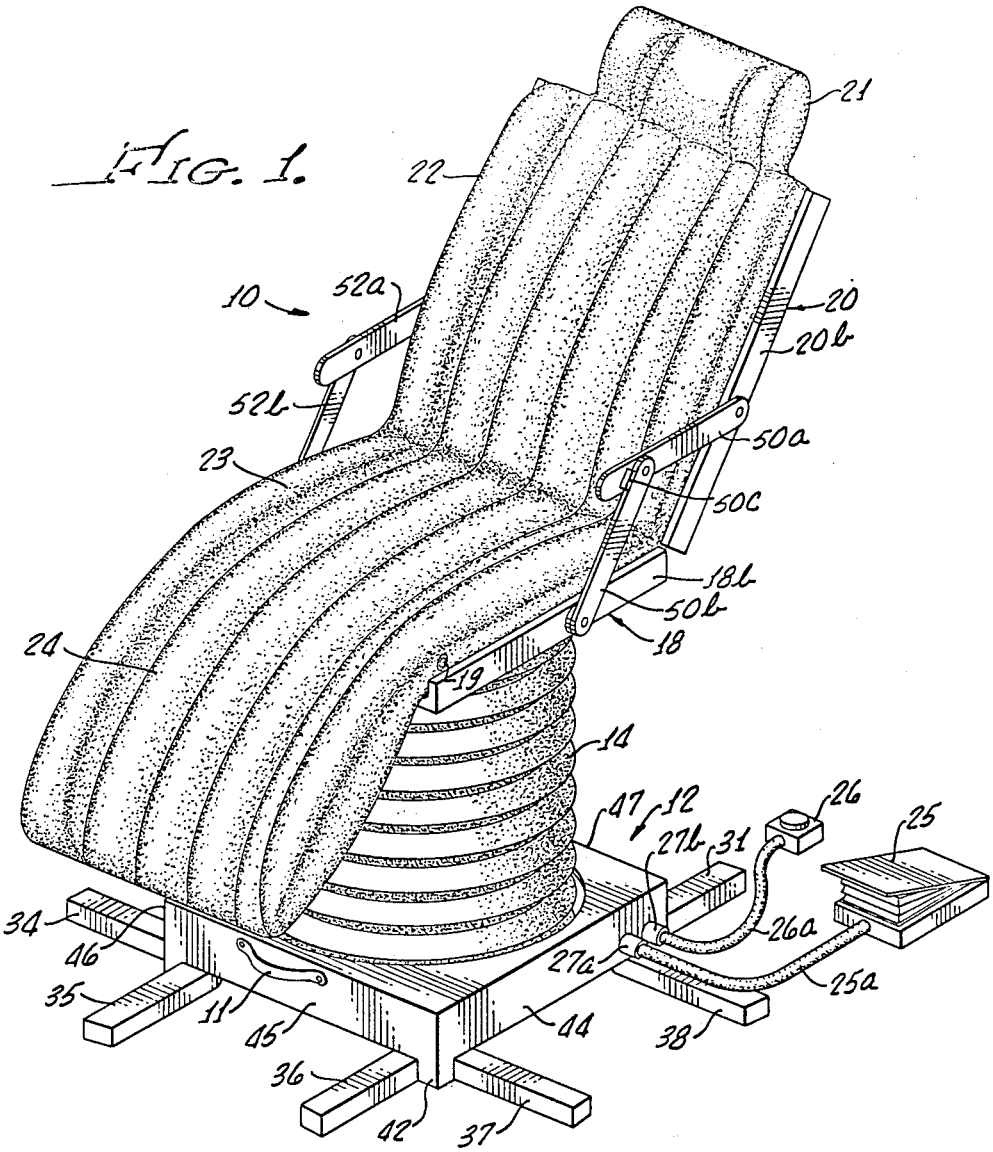
FIG. 4.
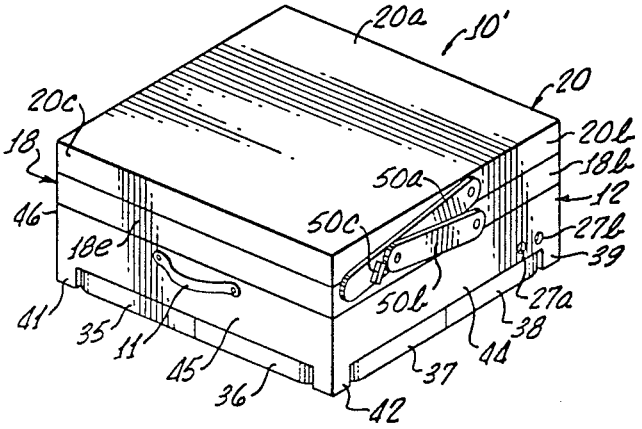
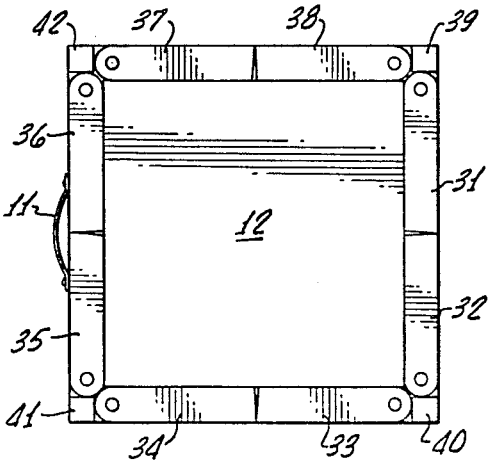
FIG. 5.

LIGHTWEIGHT TRANSPORTABLE DENTAL CHAIR

BACKGROUND OF THE INVENTION

The background of the invention will be discussed in two parts.

FIELD OF THE INVENTION

This invention relates to dental chairs, and more particularly to a lightweight, transportable dental chair, collapsible into the size of a suitcase.

DESCRIPTION OF THE PRIOR ART

Dental chairs are typically huge, bulky mechanized arrangements, requiring electrical machine driven sources of air or hydraulics for operation. In many environments, such as for field military use, or in remote locations in third world countries, medical and dental supplies and equipment have to be transported in wheeled vehicles or airplanes, and sometimes on foot or by pack animals. In such instances space and weight requirements dictate against the use of such conventional dental chairs.

A prior art folding dental chair is shown and described in U.S. Pat. No. 271,596, issued to Browne on Feb. 6, 1883, the chair being formed of interconnected pivotably attached barshaped members supporting a seat, back and footrest, with ratchet bars on the base portion for providing height adjustment.

A "Collapsible Seat" is disclosed in U.S. Pat. No. 3,419,309, which issued to Smith on Dec. 31, 1968, the seat being configured as a suitcase enclosure, with inflatable cushion members therein.

Another such suitcase apparatus is disclosed in U.S. Pat. No. 3,179,465, "Convertible Beach Chair-Suit case Combination", such patent issuing on Apr. 20, 1965 to Roberts. The suitcase is configured for enclosing therein tubular rigid frame members pivotally attached to the interior of the suit case structure.

An "Elevator Chair" is disclosed in U.S. Pat. No. 4,538,854, which issued to Wilson on Sept. 3, 1985, such patent disclosing a chair having a seat portion with an inflatable bag under the seat portion, with a vacuum device housed within the inflatable bag for providing air to the interior thereof. Sliding support members are provided at the corners of the seat.

Inflatable devices are shown and described in U.S. Pat. No. 3,112,956, entitled "Inflatable Seat and Back Rest", which issued to Schick et al. on December 3, 1963; and U.S. Patent No. 4,504,989, entitled "Inflatable Support Arrangement", which issued to Maltz on Mar. 19, 1985.

In accordance with an aspect of the invention, it is accordingly an object of the invention to provide a new and improved lightweight dental chair comprised of rigid and inflatable parts, and which may be collapsed into a suitcase size.

SUMMARY OF THE INVENTION

The foregoing and other objects of the invention are accomplished by providing afield portable dental chair, which, in its collapsed position, is configured as a suitcase with a handle for portability. The base portion of the suitcase is generally rigid and is provided on the bottom exterior with pivotable outriggers for support, while the box-like interior forms a compartment for housing a bellows arrangement for raising and lowering the chair, with a telescopic internal structure for stabilization. A seat and seat back are hingedly coupled, and have generally rigid tray-shaped configurations to form an enclosure with an inflatable cushion contained therein, inflation of which provides support for the head, back, seat and legs of a patient.

Other objects, features and advantages of the invention will become readily apparent from a reading of the specification, when taken in conjunction with the drawings, in which like reference numerals refer to like elements in the several views.

BRIEF DESCRIPTION OF THE DRAWINGS

FIG. 1 is a perspective view of the dental chair apparatus according to the invention, set up, inflated and ready for use;

FIG. 4 is a perspective view of the dental chair apparatus of FIG. 1 shown collapsed in its suitcase sized portable position; and FIG. 5 is a bottom plan view of the dental chair apparatus in its collapsed position shown in FIG. 4.

DESCRIPTION OF THE PREFERRED EMBODIMENT

Figure 2:
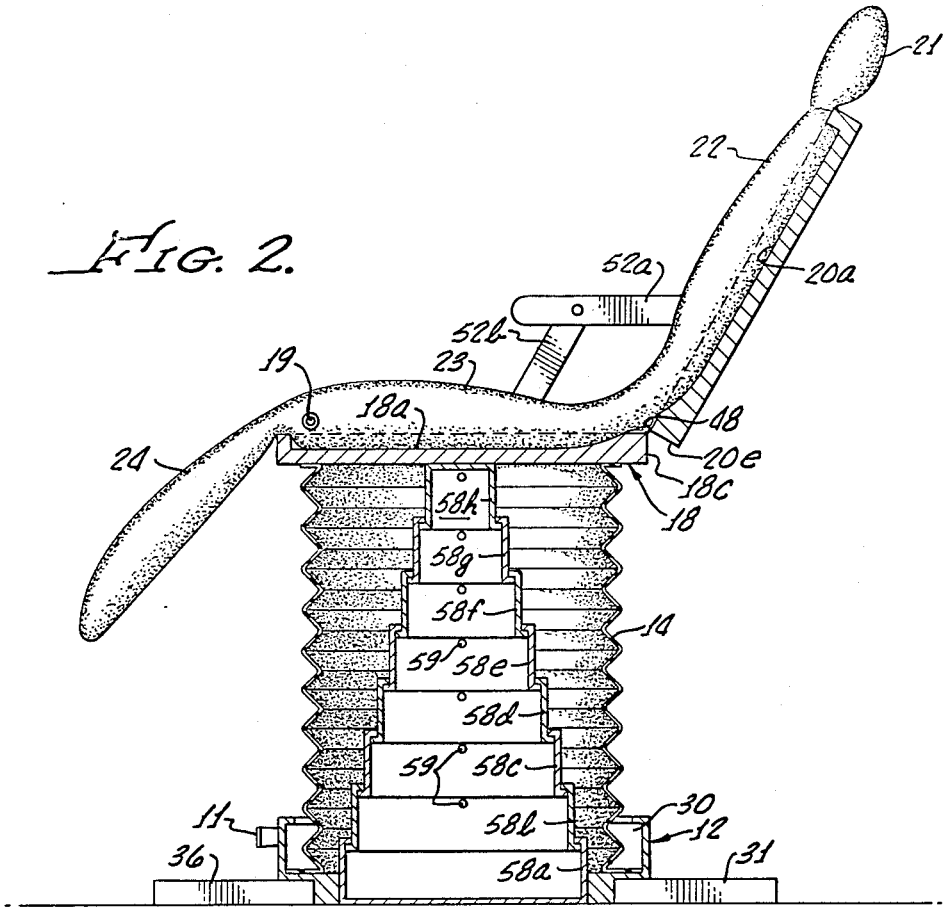
FIG. 2 a side elevational view of the dental chair apparatus of FIG. 1, partially broken away and partially in cross-section.

Referring now to the drawings, and particularly to FIGS. 1 and 2, there is shown a dental chair apparatus, generally designated 10, which generally includes a base assembly 12, an accordion pleated bellows 14, a generally rigid seat member 18, a generally rigid seat back member 20 interconnected therewith, and inflatable cushion members 21–24, for the support of the head, back, seat and legs, respectively, of an occupant of the chair 10. Attached to the base assembly 12, for introducing air into the bellows 14, is a foot pump 25; and for releasing air from the bellows 14, a foot operated air-release control 26.

As will be described, and referring also to FIG. 4, the seat member 18 and the seat back member 20 are configured as generally square shallow trays, with the base 12 configured as a somewhat deeper tray, the parts being so dimensioned, arranged and configured, to form, on collapsing or folding, a structurally rigid generally rectangular box-like or suitcase-sized package, generally designated 10' (See FIG. 4), of predetermined dimensions, wherein the planar surface of the reverse side of the seat back member 20 is one side of the suitcase thus formed, with the bottom of the base 12 being the opposing side. A suitable handle 11 is affixed to a side wall of the base 12 to facilitate carrying. As will be described, the parts are so formed that the inflatable cushion members 21–24 (in a deflated condition), the bellows 12 (in a deflated condition), and an internal structural support arrangement, are contained within the dimensions of the suitcase 10' thus formed.

Referring to FIGS. 1 and 2, and also to FIG. 5, the base 12 is generally square in bottom plan elevation, and is formed to provide an enclosure or a tray-shaped compartment 30 on the interior thereof, with a peripheral recess on the bottom exterior of the compartment 30. On the underside, the base 12 is configured for receiving, and has attached thereto, a plurality of generally bar-shaped pivotable outrigger members, or feet, 31–38.

In the folded or retracted position, the undersides of the feet 31–38 form a plane, along with the generally planar undersurface of the central compartment 30, and four corner legs 39–42. The feet 31–38 are pivoted about pivot pins **31*a*–38*a* positioned in proximity to the legs 39–42. In the retracted position, the outer edges of the legs 31–38 are coextensive with the outer walls 44–47 of the base 12. In the extended position shown in FIGS. 1 and 2, the feet 31–39 extend (as shown also in dotted lines in FIG. 5) in a direction ninety degrees to the folded position, and serve as outrigger support members, or stabilizers for the weight of the occupant or person in the chair. To facilitate pivoting, the undersurface of the legs 31–38 may be provided with finger gripping recesses 31*b*–38*b*. The corner leg members 39–42 may be formed as solid block members to provide four-corner vertical weight support for the chair 10**.

The seat member 18 and the seat back member 20 are generally identically configured with generally square generally rigid plate-shaped portions **18*a* and 20*a*, with peripheral side walls 18*b*–18*e* and 20*b*–20*e* (not all of which are shown), respectively, with the open part of each of the members in facing relation to form an enclosure for receiving therein the deflated inflatable cushion members 21–24. The seat member 18 and seat back member 20 are hingedly coupled by a suitable hinge member 48. The adjacent sides 18*b* and 20*b* of seat member 18 and seat back member 20, respectively, are interconnected by a pivotably coupled support arm set 50 including arms 50*a* and 50*b*. An identical support arm set 52 arrangement is included on the opposite side with arms 52*a* and 52*b* interconnecting adjacent sides 18*d* and 20*d* of seat member 18 and seat back member 20, respectively. Referring also to FIG. 6, the arms 50*a* and 50*b* are formed of metal bar or strap material, with arm 50*a* slightly longer than arm 50*b*. They are pivotably coupled together, such as by a rivet 51 passing through adjacent abutting ends thereof, with a portion of arm 50*a* extending beyond the so-coupled end. This portion has an outwardly extending stop member 50*c* at a position for coaction with the adjacent edge of the arm 50*b* in the pivoted position shown. The opposite end of each arm is pivotally coupled, such as by use of a rivet or screw to the walls 18*b* and 20*b*, of seat member 18 and seat back member 20, respectively, with the arm sets 50 and 52 thus providing the necessary support for maintaining the seat member 18 at a given angle to the seat back member 20**.

Figure 3:
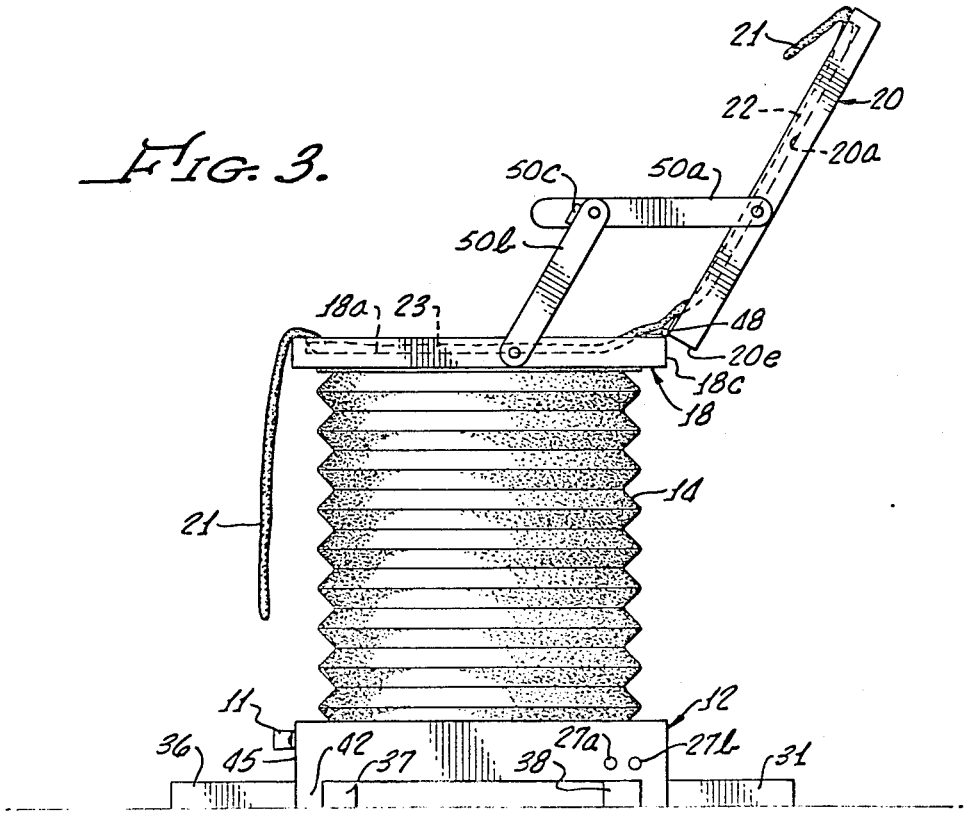
FIG. 3 is a partial side elevational view, similar to FIG. 3, with the inflatable portions deflated.

The inflatable cushion members 21–24 may be formed of a suitable plastic material as a unit, that is of one-piece construction similar to an air mattress, with the facing layers of plastic about the edges and along certain lines suitably bonded to form a plurality of air-receiving pockets. A single air valve 19 may be provided for the entire inflatable cushion structure, or individual air valves may be provided for each cushion 21–24 to provide for different amounts of air in each section, and consequently, differing amounts of stiffness or inflexibility for each section. In any event, the rearward surface of the cushion member 22, and the rearward surface of the cushion member 23 are secured, such as by adhesive to the adjacent surface **20*a* and 18*a*, of the seat back member 20 and the seat member 18, respectively. In this manner, as shown in FIG. 3, when the seat back member 20 is opened, or pivoted clockwise as viewed in the drawing relative to the seat member 18, the head cushion 21 is unfolded clockwise, and the leg support cushion 24** portion is unfolded counterclockwise, after which the cushions may be inflated.

Referring now to FIGS. 1 and 2, the means for raising and lowering the seat 18 relative to the base 12 will be described. As will be described, the portion of the chair 10 between the undersurface of the planar portion **18*a* of seat member 18 and the open end of base 21 forms a compartment or enclosure, for receiving a bellows 14, which is attached at its upper end to the undersurface of the seat member 18. At the lower end, the bellows has the lower peripheral edge thereof attached within the compartment 30 to the base 12, in airtight relation, and in a manner to be suitably contained, when collapsed, within the side walls 44–47, that is, the diameter of the bellows 14** is slightly less than the distance between the inner surfaces of an opposing set of walls.

Secured on the interior of the bellows 14, there is a structural support system, generally designated 58, which includes a plurality of telescopically interconnected members **58*a*–58*h*, of stepped dimension, each of which has an inwardly extending peripheral flange at the upper end thereof, and an outwardly extending peripheral flange at the lower end thereof, to permit the members to be received within one another in telescopic relation. The lowermost member 58*a* is generally cup-shaped, and the botom thereof may conveniently serve as the lower surface of the base 12. The uppermost member 58*h* is of an inverted cup-shaped configuration with the base thereof suitably secured, such as by bolts 57, to the undersurface of plate-shaped portion 18*a* of the seat member 18. The members 58*a*–58*h* may be cylindrical or rectangular in cross-section, and are fabricated to close tolerances to provide a backbone of vertical support for the chair apparatus 10, that is, the outer dimension of the lower flange portion is closely matched to the inner dimension of the member to which it is connected. Correspondingly, the inner dimension of the upper flange closely corresponds to the outer dimension of the cylinder to which it is connected. In order to prelude rotation of the seat 18, the members 58*a*–58*h* are preferably square in cross-section, in which event, the members are self-keyed to one another. Alternatively, the members 58*a*–58*h* may be cylindrical, with suitable keying means (not shown) formed at the periphery, such as a vertical slot in one member, with a rib or shaft member coacting within the slot to limit the movement of the members relative to one another to a vertical direction. To provide the tightness of fit, while permitting ease of movement in the vertical direction, the cylinders may be conveniently formed of a suitable self-lubricating plastic material, such as Teflon, or Delrin material. In addition, such materials offer lightness of weight. To further facilitate upward and downward movement, some, or all of the members 58*a*–58*f* may be provided with venting apertures 59, or one way air valves, not shown, arranged to permit ease of raising the seat 18, with slight resistance to downward movement without the chair 10** being occupied.

For purposes of filling of the bellows 14 with air, a foot operated pump 25 is provided, interconnected through tubing **25*a* to a valve arrangement 27*a* which passes through the wall 44 into communication with the interior of the bellows 14. A foot-operated air release control 26 is connected through tubing 26*a* to a valve 27*b* passing through wall 44. Conveniently, the pump 25 and the control 26 would be on a common plate for ease of use by the dentist. Of, course, the pump 25 may also be used to inflate the cushion members 21–24**.

The material used to make the rigid members 12, 18, 20, and 31–38 may be any suitable lightweight material, such as fiberglass, high impact plastics, plywood or any combination thereof. Similarly, molded lightweight metal parts of aluminum or magnesium may be judiciously used, in part, with the overall selection of materials thus providing a high strength lightweight, field portable dental chair 10, which may be readily erected for use, and readily disassembled and folded for transport, all in a suitcase size, such as eighteen inches square by seven inches deep.

Thus it may be seen that the construction, configuration, dimensions, and arrangement of the various components of the chair 10 provide first and second compartments, or enclosures, bounded by generally rigid members, for completely receiving and enclosing therein the flexible or inflatable portions of the chair 10, along with the flexible bellows 14 being configured for housing the telescopic structural support system 58 on the interior thereof. While there has been shown and described a preferred embodiment, it is to be understood that various other adaptations and modifications may be made within the spirit and scope of the invention.

What I claim is:

1. Chair apparatus collapsible between a first erect position ready for use by an occupant, and a second position in which the parts assume the configuration of a closed box of predetermined dimensions, said apparatus comprising:

first and second generally rigid, generally tray-shaped members coupled and dimensioned to form an enclosure, said first member being configured and dimensioned for forming seat means for an occupant and said second member being configured for providing seat back means for an occupant;

inflatable cushion means contained within said enclosure and operative upon unfolding of said second member relative to said first member and upon inflation of said cushion means to provide bodily support for an occupant;

a generally rigid, generally tray-shaped base portion having an open end dimensionally configured for closure by said first member for forming compartment means;

bellows means within said compartment means operatively attached to said first member and said base portion for enabling adjustable spaced displacement of said first member relative to said open end upon actuation thereof; and structural support means within said compartment means and within said bellows means and operatively attached to said first member and said base portion for assisting in maintaining the position of said first member relative to said base portion during adjustable spaced displacement of said first member relative to said open end.

2. The apparatus according to claim 1 wherein said structural support means are actuable in response to actuation of said bellows means.

3. The apparatus according to claim 2 wherein said structural support means includes telescopic members within said bellows means.

4. The apparatus according to claim 1 wherein said base portion further includes stabilizing means.

5. The apparatus according to claim 1 wherein said first member, said second member and said base portion are configured and dimensioned to provide a closed box configuration of generally rectangular proportions.

6. The apparatus according to claim 5 wherein said base portion further includes stabilizing means pivotable from a first retracted position within the dimensional limits of the box configuration to an extended posiiton beyond said limits.

7. The apparatus according to claim 6 wherein said stabilizing means are outrigger members pivotable between a closed position and an open position for stabilizing the apparatus, and said base portion is configured for receiving said outrigger members, in the closed position, within said predetermined dimensions.

8. The apparatus according to claim 1 wherein said cushion means are secured within said enclosure to at least one of said first and second members.

9. The apparatus according to claim 1 wherein said cushion means includes a first portion for overlying said first member, a second portion for overlying said second member and a third portion which, when inflated, extends beyond said first member to provide leg support for an occupant.

10. The apparatus according to claim 9 wherein said cushion means further includes a fourth portion which, when inflated, extends beyond said second member to provide head support for an occupant.

11. A portable dental chair apparatus collapsible between a first erect position and a second position in which the parts assume the configuration of a box, said apparatus comprising:

base means for positioning on a supporting surface, said base means including compartment means;

means pivotally coupled to said base means for extending outwardly therefrom for engagement with the supporting surface for providing additional support for said apparatus in said first position;

bellows means having a first end attached to said base means, said bellows means being dimensioned and configured for being contained within said compartment means with said apparatus in said second position;

seat means including a generally rigid portion, said seat means being coupled to the other end of said bellows means, said seat means being raised, lowered, and height adjusted in response to actuation of said bellows means;

means within said enclosure and within said bellows means, collapsible therein with said apparatus in said second position and extendible with said bellows means for providing structural support for an occupant of said apparatus;

seat back means including a generally rigid portion movably coupled to said seat means for adjustable positioning relative thereto, said seat means and said seat back means being configured for forming an enclosure with said apparatus in said second position; and inflatable cushion means in cooperative relation with said seat means and said seat back means for being inflated to provide support for the head, back, seat and legs of a user with the apparatus in said first position and for being contained within said enclosure with said apparatus in said second position and said inflatable means in the deflated condition.

12. The apparatus according to claim 11 wherein said means within said enclosure and within said bellows means includes telescopically interconnected generally rigid structural support members interconnecting said base means and the undersurface of said seat means and operably telescoped in response to actuation of said bellows means.

13. The apparatus accfording to claim 11 wherein said means pivotally coupled to said base means are outrigger members pivotable between a closed position and an open position for stabilizing the apparatus, and said base means is a base member configured for receiving said outrigger members, in the closed position, within the dimensions of the box formed by said apparatus in the second position.

14. The apparatus according to claim 11 wherein said inflatable cushion means are secured within said enclosure to at least one of said first and second members.

15. The apparatus according to claim 11 wherein said inflatable cushion means includes a first portion for overlying said seat means, a second portion for overlying said seat back means and a third portion which, when inflated, extends beyond said seat means to provide leg support for an occupant.

16. The apparatus according to claim 15 wherein said cushion means further includes a fourth portion which, when inflated, extends beyond said seat back means to provide head support for an occupant.

17. Portable chair apparatus collapsible between a first erect position ready for use by an occupant, and a second position in which the parts assume the configuration of a closed box of predetermined dimensions, said apparatus comprising:

first and second generally rigid, generally tray-shaped members hingedly coupled and dimesnioned to form an enclosure, said first member being configured and dimensioned for forming seat means for an occupant and said second member being configured for providing seat back means for an occupant;

inflatable cushion means contained within said enclosure and operative upon unfolding of said second member relative to said first member and upon inflation of said cushion means to provide bodily support for an occupant;

a generally rigid, generally tray-shaped base portion having an open end dimensionally configured for closure by said first member for forming compartment means;

bellows means within said compartment means operatively attached to said first member and said base portion for enabling adjustable positioning and spaced displacement of said first member relative to said open end upon actuation of said bellows means; and structural support means within said bellows means, said support means being operatively attached to said first member and said base portion for extension in response to actuation of said bellow means, said support means and said bellows means conjointly providing support for said first member at any position thereof relative to said base means.

18. The apparatus according to claim 17 wherein said base portion further includes stabilizing means pivotable from a first retracted position within the dimensional limits of the box configuration to an extended position beyond said limits, said stabilizing means being outrigger members pivotable between a closed position and an open position for stabilizing the apparatus, and said base portion is configured for receiving said outrigger members, in the closed position, within said predetermined dimensions.

19. The apparatus according to claim 18 wherein said inflatable cushion means are secured within said enclosure to at least one of said first and second members.

20. The apparatus according to claim 19 wherein said inflatable cushion means includes a first portion for overlying said seat means, a second portion for overlying said seat back means and a third portion which, when inflated, extends beyond said seat means to provide leg support for an occupant.

* * * * *